US008955422B1

(12) United States Patent
Schumacher

(10) Patent No.: US 8,955,422 B1
(45) Date of Patent: Feb. 17, 2015

(54) MODIFIED BOLT CARRIER FOR AUTOMATIC RECOIL RIFLES AND PISTOLS

(71) Applicant: Theodore R. Schumacher, Berlin, WI (US)

(72) Inventor: Theodore R. Schumacher, Berlin, WI (US)

( * ) Notice: Subject to any disclaimer, the term of this patent is extended or adjusted under 35 U.S.C. 154(b) by 0 days.

(21) Appl. No.: 14/104,348

(22) Filed: Dec. 12, 2013

(51) Int. Cl.

| | |
|---|---|
| ***F41A 3/78*** | (2006.01) |
| ***F41A 3/12*** | (2006.01) |
| ***F41A 5/02*** | (2006.01) |
| ***F41A 25/10*** | (2006.01) |
| ***F41C 23/04*** | (2006.01) |

(52) U.S. Cl.
CPC ... *F41A 3/12* (2013.01); *F41A 5/02* (2013.01); *F41A 25/10* (2013.01); *F41C 23/04* (2013.01)
USPC ..... 89/198; 89/193; 89/191.01; 89/199; 42/75.03; 42/72; 42/73

(58) Field of Classification Search
USPC ..... 42/1.06, 71.01, 72, 73, 74, 75.03, 97; 89/191.01, 193, 198, 199
See application file for complete search history.

(56) References Cited

U.S. PATENT DOCUMENTS

| | | | | | |
|---|---|---|---|---|---|
| 3,363,351 | A * | 1/1968 | Smith | 42/16 |
| 3,771,415 | A * | 11/1973 | Into et al. | 89/16 |
| 3,776,095 | A * | 12/1973 | Atchisson | 89/128 |
| 4,028,993 | A * | 6/1977 | Reynolds | 89/130 |
| 4,231,177 | A * | 11/1980 | Foote | 42/16 |
| 4,433,610 | A * | 2/1984 | Tatro | 89/148 |
| 5,272,956 | A | 12/1993 | Hudson | |
| 7,398,616 | B1 * | 7/2008 | Weir | 42/73 |
| 7,444,775 | B1 * | 11/2008 | Schuetz | 42/76.01 |
| 7,966,761 | B1 * | 6/2011 | Kuczynko et al. | 42/73 |
| 8,418,389 | B1 * | 4/2013 | Lukman et al. | 42/1.06 |
| 8,584,575 | B2 * | 11/2013 | Crommett | 89/193 |
| 8,769,855 | B2 * | 7/2014 | Law | 42/75.03 |
| 2006/0236853 | A1 * | 10/2006 | Boersching et al. | 89/198 |
| 2011/0131857 | A1 * | 6/2011 | Kuczynko et al. | 42/73 |
| 2011/0252957 | A1 * | 10/2011 | Overstreet et al. | 89/128 |
| 2011/0271827 | A1 * | 11/2011 | Larson et al. | 89/193 |
| 2012/0137562 | A1 * | 6/2012 | Langevin et al. | 42/75.03 |
| 2012/0137872 | A1 * | 6/2012 | Crommett | 89/193 |
| 2012/0180353 | A1 * | 7/2012 | Holmberg | 42/1.06 |
| 2013/0036900 | A1 * | 2/2013 | Mueller | 89/191.01 |
| 2014/0041518 | A1 * | 2/2014 | Neitzling | 89/191.01 |
| 2014/0190056 | A1 * | 7/2014 | Troy et al. | 42/71.01 |
| 2014/0208627 | A1 * | 7/2014 | Ballard | 42/75.03 |

* cited by examiner

*Primary Examiner* — Bret Hayes
*Assistant Examiner* — Derrick Morgan
(74) *Attorney, Agent, or Firm* — Donald J. Ersler

(57) ABSTRACT

A modified bolt carrier for automatic recoil rifles and pistols preferably includes a shortened bolt carrier, a shortened buffer tube, a modified bolt key and an end cap. The shortened buffer tube is shortened by cutting-off a straight portion of a prior buffer tube. The modified bolt key includes a prior art bolt key, a rod yoke, a pair spring rods, a pair of compression springs, a spring support disc and a spring plug. The spring plug is biased outward from the shortened bolt carrier with the pair of compression springs. The modified bolt key is attached to the shortened bolt carrier and retained in upper and lower receivers of an automatic recoil rifle or pistol. The bolt spring is slipped over the spring plug and the bolt spring is retained by securing the end cap to the lower receiver with a lock pin.

18 Claims, 7 Drawing Sheets

MODIFIED BOLT CARRIER FOR AUTOMATIC RECOIL RIFLES AND PISTOLS

BACKGROUND OF THE INVENTION

1. Field of the Invention

The present invention relates generally to firearms and more specifically to a modified bolt carrier for automatic recoil rifles and pistols, which allows a greater variety of stocks to be attached to the automatic recoil rifles and pistols.

2. Discussion of the Prior Art

U.S. Pat. No. 5,272,956 to Hudson discloses a recoil gas system for rifle. U.S. Pat. No. 8,584,575 to Crommett discloses a firearm having a new gas operating system. It appears that the prior art does not teach or suggest eliminating the need for shortened buffer tubes, which allows automatic recoil rifles and pistols to accommodate a greater variety of stocks including folding stocks, telescopic stocks, wire stocks, or any other buffer-less type of stocks.

Accordingly, there is a clearly felt need in the art for a modified bolt carrier for automatic recoil rifles and pistols, which allows automatic recoil rifles to accommodate a greater variety of stocks including folding stocks, telescopic stocks, wire stocks, or any other buffer-less type of stocks.

SUMMARY OF THE INVENTION

The present invention provides a modified bolt carrier for automatic recoil rifles and pistols, which allows a greater variety of stocks to be attached to the automatic recoil rifles and pistols. The modified bolt carrier for automatic recoil rifles and pistols (modified bolt carrier) preferably includes a shortened bolt carrier, a shortened buffer tube, a modified bolt key and an end cap. The shortened bolt carrier is shortened by cutting-off a prior art bolt carrier, adjacent an end of the bolt key. A prior art bolt tube carrier includes a straight portion and a threaded portion. The straight portion extends from the threaded portion. The shortened buffer tube is created by cutting-off the straight portion of a prior art buffer tube, such that the straight portion has a length, which is about the same as the diameter thereof.

The modified bolt key includes a prior art bolt key, a rod yoke, a pair spring rods, a pair of compression springs, a spring support disc and a spring plug. The rod yoke extends from an end of the prior art bolt key. The spring plug extends from the spring support disc. The pair of spring rods are preferably pressed into an end of the spring support disc, but could be threaded, welded or secured with any other suitable method. The rod yoke includes two rod holes to slidably receive the pair of spring rods. The pair of compression springs are slid on to the pair of spring rods. The pair of spring rods are slid into the two rod holes and axially retained with any suitable device.

The end cap includes a buffer tube bore and a buffer plate projection bore. The buffer tube bore is sized to slidably receive an end of the shortened buffer tube. The buffer plate projection bore is sized to receive a projection of a buffer plate. A lock hole is formed through the buffer plate projection bore, substantially perpendicular to an axis of the buffer plate projection bore.

Installation of the modified bolt carrier includes the removal of the prior art buffer tube from a lower receiver of the automatic recoil rifle. The prior art bolt carrier is replaced with the shortened bolt carrier and the modified bolt key. The shortened buffer tube is screwed into the lower receiver. A rifle stock or a folding interface is attached to a rear of the end cap. Finally, a bolt spring is inserted into the shortened buffer tube and the end cap is secured to the buffer plate projection by inserting a lock pin through the lock hole and the buffer plate projection.

Accordingly, it is an object of the present invention to provide a modified bolt carrier, which allows automatic recoil rifles and pistols to accommodate a greater variety of stocks including folding stocks, telescopic stocks, wire stocks, or any other buffer-less type of stocks.

These and additional objects, advantages, features and benefits of the present invention will become apparent from the following specification.

DETAILED DESCRIPTION OF THE PREFERRED EMBODIMENTS

Figure 1:
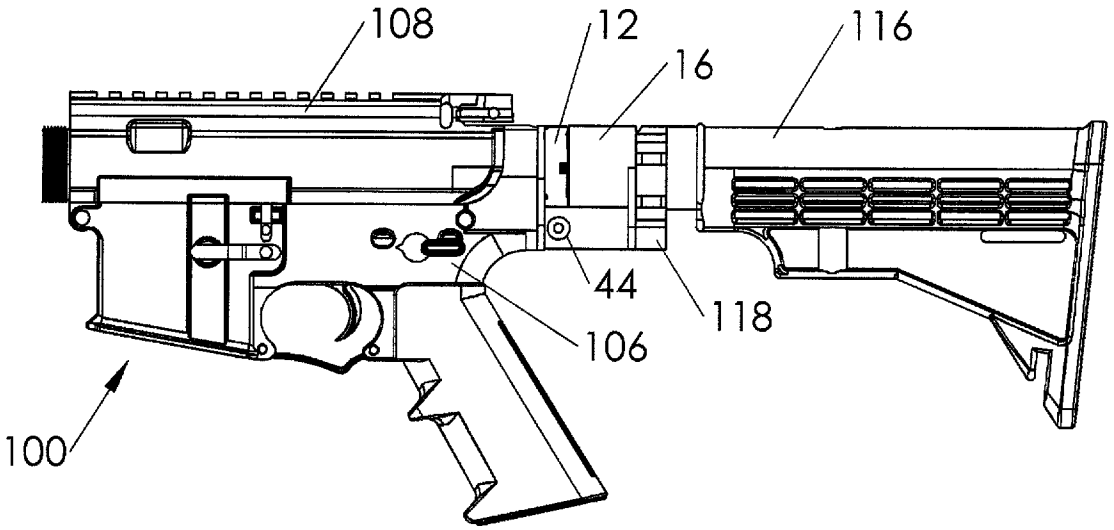
FIG. 1 is a side view of a rear portion of an automatic recoil rifle with a modified bolt carrier installed therein in accordance with the present invention.
Figure 2:
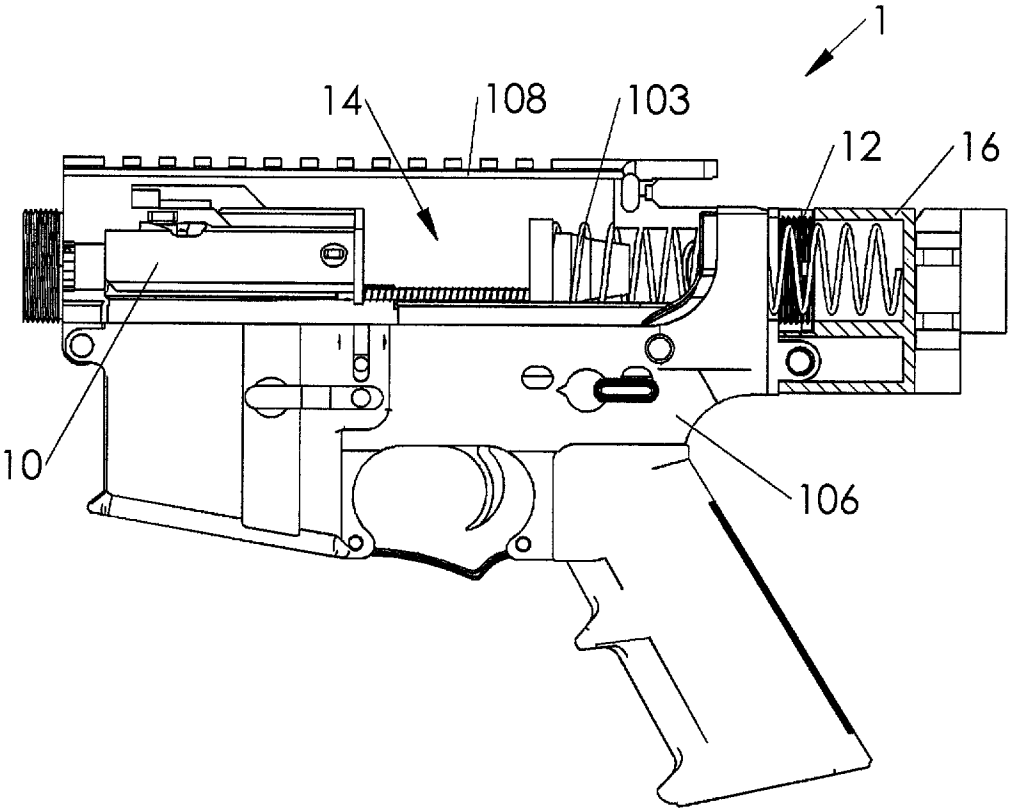
FIG. 2 is a side cutaway view of upper and lower receivers of an automatic recoil rifle with a modified bolt carrier installed therein in accordance with the present invention.

With reference now to the drawings, and particularly to FIG. 2, there is shown a side cutaway view of upper and lower receivers of an automatic recoil rifle 100 with a modified bolt carrier 1 installed therein. With reference to FIGS. 1 and 3-5, the modified bolt carrier 1 preferably includes a shortened bolt carrier 10, a shortened buffer tube 12, a modified bolt key 14 and an end cap 16. With reference to FIG. 6, the shortened buffer tube 12 is shortened by cutting-off a straight portion 18 of a prior art buffer tube, such that the straight portion 18 preferably has a length, which is about the same as an outer diameter of the straight portion 18.

Figure 5:
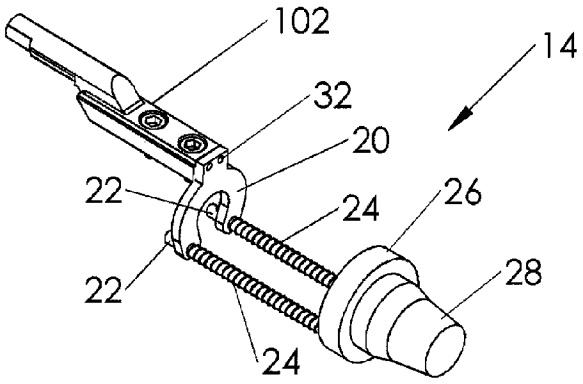
FIG. 5 is a perspective view of a modified bolt key of a modified bolt carrier in accordance with the present invention.
Figure 4:
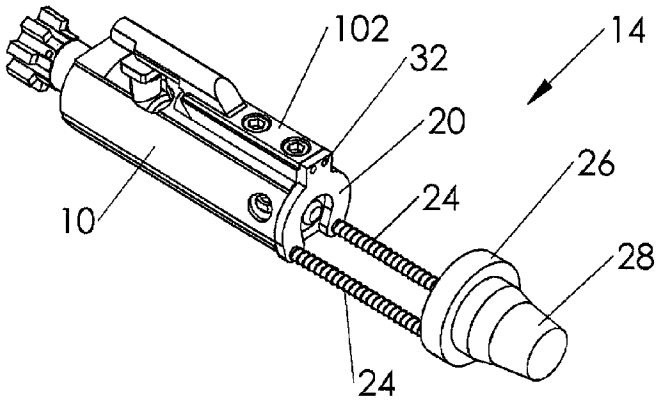
FIG. 4 is a perspective view of a modified bolt key attached to a shortened bolt carrier of a modified bolt carrier in accordance with the present invention.
Figure 6:
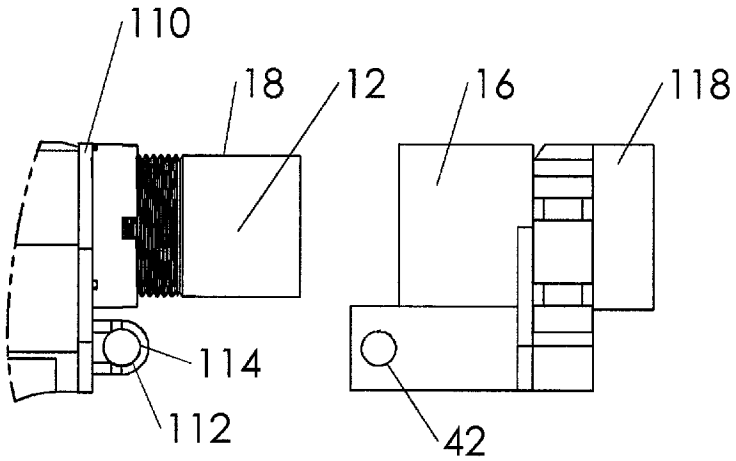
FIG. 6 is a side view of a portion of a lower receiver of an automatic recoil rifle with a shortened buffer tube retained therein and an end cap detached from the shortened buffer tube of a modified bolt carrier in accordance with the present invention.

With reference to FIGS. 4-5, the modified bolt key 14 preferably includes a prior art bolt key 102, a rod yoke 20, a pair spring rods 22, a pair of compression springs 24, a spring support disc 26 and a spring plug 28. The rod yoke 20 may be secured to an end of the prior art bolt key 102 with a pair of fasteners 32 or the like. However, the rod yoke 20 may also be formed as an integral part of the prior art bolt key 102. A pair of rod bores are formed in a bottom of the rod yoke 20 to slidably receive the pair of spring rods 22. One end of the pair of spring rods 22 are preferably pressed into one end of the spring support disc 26, but could be threaded, welded or secured with any other suitable method.

The pair of compression springs 24 are slipped over the pair of spring rods 22. The other end of the pair of spring rods 22 are inserted into the pair of rod bores. The other end of the pair of spring rods 22 are retained axially in the rod yoke 20 by peening, fasteners or any other suitable method. The pair of rod bores are located in the rod yoke 20, such that there is enough clearance for the pair of spring rods 22 to freely travel, under a bottom of the shortened bolt carrier 10, when the pair of compression springs 24 are compressed.

Figure 3:
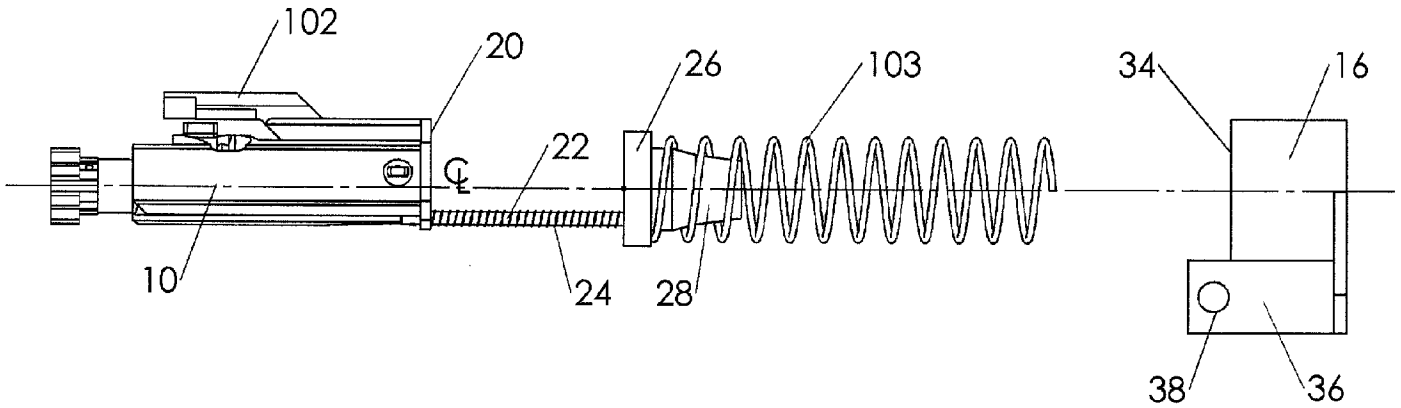
FIG. 3 is a side view of a shortened bolt carrier, a modified bolt key, a bolt spring and an end cap of a modified bolt carrier in accordance with the present invention.
Figure 3A:
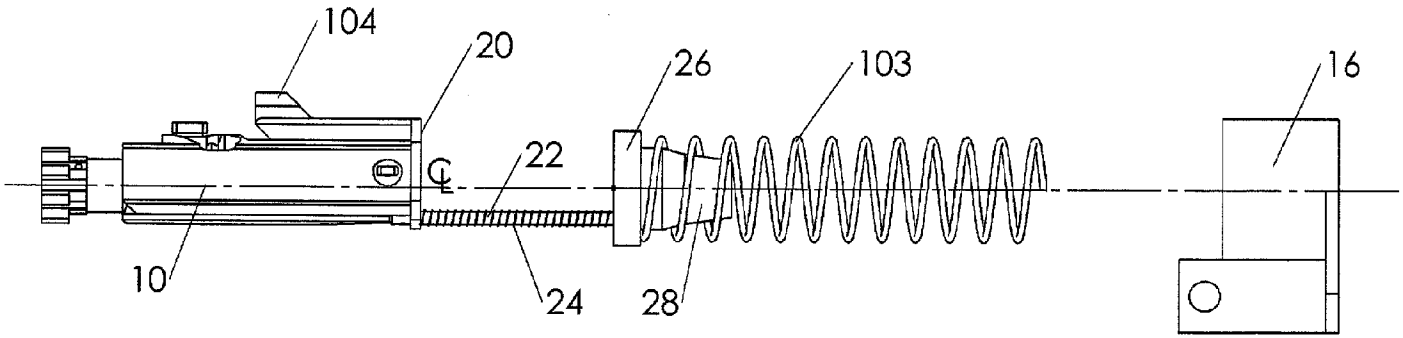
FIG. 3*a* is a side view of a shortened bolt carrier, a modified bolt key, a bolt spring and an end cap of a modified bolt carrier that accommodates a piston rod in accordance with the present invention.

The spring plug 28 is preferably tapered to receive an inner perimeter of a bolt spring 103. The spring plug 28 extends from the other end of the spring support disc 26. A centerline of the spring plug 28 is concentric with a centerline of the shortened bolt carrier 10. With reference to FIG. 3*a*, a prior art bolt key 104 is shown. The prior art bolt key 104 is used to receive a piston rod (not shown). With reference to FIG. 2, the modified bolt carrier 1 is retained in a lower receiver 106 and an upper receiver 108 of the automatic recoil rifle 100.

Figure 7:
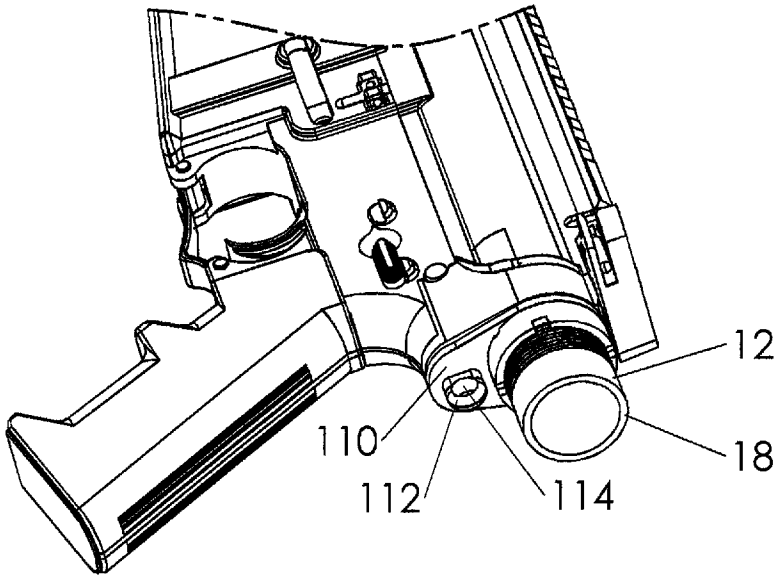
FIG. 7 is a perspective end view of a portion of an automatic recoil rifle with a shortened buffer tube retained therein of a modified bolt carrier in accordance with the present invention.
Figure 8:
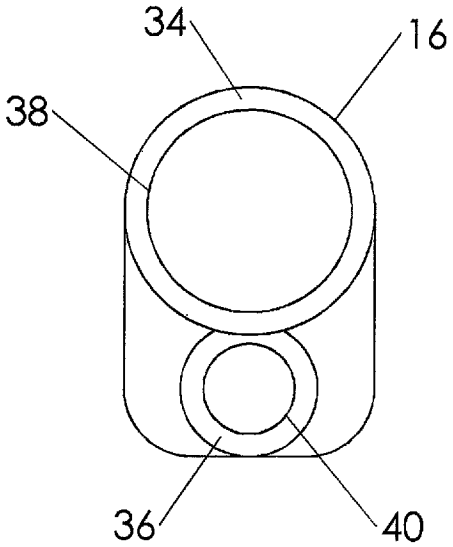
FIG. 8 is an end view of an end cap of a modified bolt carrier in accordance with the present invention.

With reference to FIGS. 6-8, the end cap 16 includes a cap portion 34 and a tube portion 36. The tube portion 36 is formed on a bottom of the cap portion 34. A buffer tube bore 38 is formed in an inner perimeter of the cap portion 34. The buffer tube bore 38 is sized to slidably receive the straight portion 18 of the shortened buffer tube 12. A buffer plate projection bore 40 is formed in an inner perimeter of the tube portion 36. The buffer plate projection bore 40 is sized to receive a buffer projection 112 of a buffer plate 110. The buffer projection 112 includes a buffer lock hole 114. A lock hole 42 is formed through the buffer plate projection bore 40, substantially perpendicular to an axis of the buffer plate projection bore 40.

Installation of the modified bolt carrier 1 includes unscrewing the prior art buffer tube from the lower receiver 106. The prior art bolt carrier is replaced with the shortened bolt carrier 10 and the modified bolt key 14 attached to the shortened bolt carrier 10. The lower receiver 106 may be separated from the upper receiver 108 to install the shortened bolt carrier 10 and the modified bolt key 14. A rifle stock 116 or a folding interface 118 is attached to a rear of the end cap 16. With reference to FIG. 1, the bolt spring 103 is inserted through the shortened buffer tube 12 and the end cap 16 is secured to the buffer projection 112 by inserting a lock pin 44 through the lock hole 42 and the buffer lock hole 114.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A modified bolt carrier for automatic recoil rifles and pistols comprising:

a bolt carrier;

a buffer tube includes an inner perimeter that is sized to receive a bolt spring;

a modified bolt key includes a bolt key and a spring plug, said spring plug is biased away from said bolt key, said bolt key is attached to said bolt carrier, said spring plug is sized to receive an inner perimeter of the bolt spring; and an end cap having a buffer tube bore, said buffer tube bore is sized to receive an outer perimeter of said buffer tube, wherein said bolt carrier with said modified bolt key are inserted into an upper receiver of the automatic recoil rifle, a bolt spring is slipped over said spring plug, said end cap is slipped over said buffer tube and secured to the lower receiver.

2. The modified bolt carrier for automatic recoil rifles and pistols of claim 1 wherein:

said buffer tube includes a threaded portion and a straight portion, a length of said straight portion is about equal to a diameter of said straight portion.

3. The modified bolt carrier for automatic recoil rifles and pistols of claim 1 wherein:

said bolt carrier includes a prior art bolt carrier, said prior art bolt carrier is modified by cutting-off an end adjacent an end of said modified bolt key.

4. The modified bolt carrier for automatic recoil rifles and pistols of claim 1 wherein:

said end cap includes a cap portion and a tube portion, said tube portion is formed on a bottom of said cap portion, an inner perimeter of said cap portion is sized to receive said buffer tube, an inner perimeter of said tube portion is sized to receive a buffer projection of a buffer plate.

5. The modified bolt carrier for automatic recoil rifles and pistols of claim 4, further comprising:

a lock pin for insertion through said tube portion and the buffer projection.

6. The modified bolt carrier for automatic recoil rifles and pistols of claim 1 wherein:

one of a rifle stock and a folding interface is attached to a rear of said end cap.

7. A modified bolt carrier for automatic recoil rifles and pistols comprising:

a bolt carrier;

a buffer tube includes an inner perimeter that is sized to receive a bolt spring;

a modified bolt key includes a bolt key and a spring plug, said spring plug is biased away from said bolt key, said bolt key is attached to said bolt carrier, said spring plug is sized to receive an inner perimeter of the bolt spring, a centerline of said spring plug is concentric with a centerline of said bolt carrier; and an end cap having a buffer tube bore, said buffer tube bore is sized to receive an outer perimeter of said buffer tube, wherein said bolt carrier with said modified bolt key are inserted into an upper receiver of the automatic recoil rifle, a bolt spring is slipped over said spring plug, said end cap is slipped over said buffer tube and secured to the lower receiver.

8. The modified bolt carrier for automatic recoil rifles and pistols of claim 7 wherein:

said buffer tube includes a threaded portion and a straight portion, a length of said straight portion is about equal to a diameter of said straight portion.

9. The modified bolt carrier for automatic recoil rifles and pistols of claim 7 wherein:

said bolt carrier includes a prior art bolt carrier, said prior art bolt carrier is modified by cutting-off an end adjacent an end of said modified bolt key.

10. The modified bolt carrier for automatic recoil rifles and pistols of claim 7 wherein:

said end cap includes a cap portion and a tube portion, said tube portion is formed on a bottom of said cap portion, an inner perimeter of said cap portion is sized to receive said buffer tube, an inner perimeter of said tube portion is sized to receive a buffer projection of a buffer plate.

11. The modified bolt carrier for automatic recoil rifles and pistols of claim 10, further comprising:

a lock pin for insertion through said tube portion and the buffer projection.

12. The modified bolt carrier for automatic recoil rifles and pistols of claim 7 wherein:

one of a rifle stock and a folding interface is attached to a rear of said end cap.

13. A modified bolt carrier for automatic recoil rifles and pistols comprising:

a bolt carrier;

a buffer tube having a straight portion and a threaded portion, said straight portion extends from said threaded portion, said buffer tube includes an inner perimeter that is sized to receive a bolt spring;

a modified bolt key includes a bolt key and a spring plug, said spring plug is biased away from said bolt key, said bolt key is attached to said bolt carrier, said spring plug is sized to receive an inner perimeter of the bolt spring; and an end cap having a buffer tube bore, said buffer tube bore is sized to receive an outer perimeter of said straight portion, wherein said threaded portion is threaded into an upper receiver of the automatic recoil rifle, said bolt carrier with said modified bolt key are inserted into the lower receiver, a bolt spring is slipped over said spring plug, said end cap is slipped over said straight portion and secured to the lower receiver.

14. The modified bolt carrier for automatic recoil rifles and pistols of claim 13 wherein:

a length of said straight portion is about equal to a diameter of said straight portion.

15. The modified bolt carrier for automatic recoil rifles and pistols of claim 13 wherein:

said bolt carrier includes a prior art bolt carrier, said prior art bolt carrier is modified by cutting-off an end adjacent an end of said modified bolt key.

16. The modified bolt carrier for automatic recoil rifles and pistols of claim 13 wherein:

said end cap includes a cap portion and a tube portion, said tube portion is formed on a bottom of said cap portion, an inner perimeter of said cap portion is sized to receive said buffer tube, an inner perimeter of said tube portion is sized to receive a buffer projection of a buffer plate.

17. The modified bolt carrier for automatic recoil rifles and pistols of claim 16, further comprising:

a lock pin for insertion through said tube portion and the buffer projection.

18. The modified bolt carrier for automatic recoil rifles and pistols of claim 13 wherein:

one of a rifle stock and a folding interface is attached to a rear of said end cap.

* * * * *